United States Patent [19]

Howell et al.

[11] 4,220,068

[45] Sep. 2, 1980

[54] METHOD AND APPARATUS FOR RHYTHMIC NOTE PATTERN GENERATION IN ELECTRONIC ORGANS

[75] Inventors: Stephen L. Howell; Ralph N. Dietrich; John W. Robinson, all of Jasper; James P. Osburn, Terre Haute, all of Ind.

[73] Assignee: Kimball International, Inc., Jasper, Ind.

[21] Appl. No.: 932,226

[22] Filed: Aug. 9, 1978

[51] Int. Cl.[2] ..... G10F 1/00; G10H 1/00

[52] U.S. Cl. ..... 84/1.03; 84/1.01; 84/1.17; 84/DIG. 12; 84/DIG. 22

[58] Field of Search ..... 84/1.01, 1.03, 1.17, 84/1.28, DIG. 8, DIG. 11, DIG. 12, DIG. 22

[56] References Cited

U.S. PATENT DOCUMENTS

| | | | |
|---|---|---|---|
| 3,951,028 | 4/1976 | Robinson | 84/1.03 |
| 3,990,339 | 11/1976 | Robinson | 84/1.03 |
| 4,020,728 | 5/1977 | Robinson | 84/1.03 |
| 4,055,103 | 10/1977 | Machanian | 84/DIG. 11 |
| 4,072,078 | 2/1978 | Shallenberger | 84/DIG. 22 |
| 4,108,037 | 8/1978 | Robinson | 84/1.03 |
| 4,112,802 | 9/1978 | Robinson | 84/1.01 |
| 4,120,225 | 10/1978 | Dietrich | 84/1.03 |
| 4,144,788 | 3/1979 | Bione | 84/1.01 |
| 4,147,085 | 4/1979 | Robinson | 84/1.01 |
| 4,148,241 | 4/1979 | Morez | 84/1.03 |

*Primary Examiner*—J. V. Truhe
*Assistant Examiner*—William L. Feeney
*Attorney, Agent, or Firm*—Albert L. Jeffers; John F. Hoffman

[57] ABSTRACT

A circuit for an electronic organ for producing rhythmic patterns of notes in accordance with the selection of a chord in the accompaniment manual. The organ includes an accompaniment manual and a solo manual, either or both of which may be electronically scanned to develop a multiplexed data stream, and a chord generation circuit controlled by the accompaniment manual for sounding groups of notes in the accompaniment voices in response to the depression of one of the selected group of keys on the accompaniment manual. The circuit according to the present invention automatically sounds notes of the solo manual in a rhythmic pattern in response to the depression of one of the group of accompaniment manual keys by developing a logic pulse at the beginning of the top octave scan which is delayed in time to correspond to the time slot of the chord root note and subsequent notes of the chord. The amount of delay is controlled by pre-programmed patterns preselected by the musician.

24 Claims, 5 Drawing Figures

SPKR
30
AMPS
28
TABS
VOICES
26
TONE GEN.
24
SOLO KEYERS
22
SOLO DEMUX
20
PATTERN SELECT
54
18
SOLO MANUAL
10
SOLO MPX R
12
SOLO CHORD PROCESSOR
44
NOTE PATTERN PROCESSOR
46
+V
OFF
ON
14
16
TABS
VOICING
42
TONE GEN.
40
ACCOMP KEYERS
38
ACCOMP DEMUX
36
35
ACCOMP MANUAL
32
ACCOMP MPX R
34
CHORD ENCODE
OFF
ON
37
VOL.
VOICING
RHYTHM TABS
RHYTHM UNIT
50

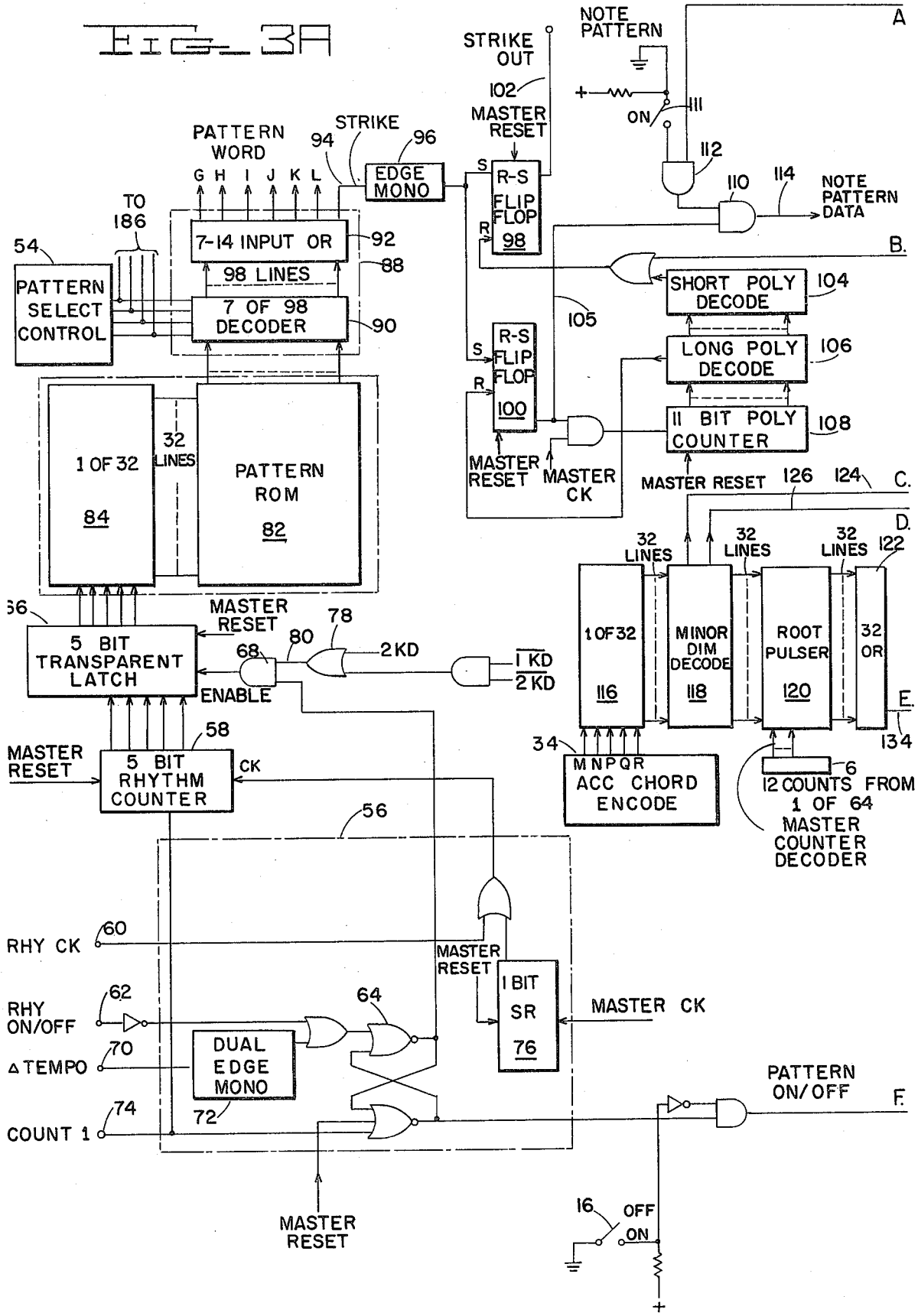
FIG. 3A
STRIKE OUT
102
MASTER RESET
NOTE PATTERN
A
ON
111
112
110
114
NOTE PATTERN DATA
PATTERN WORD
G H I J K L
STRIKE
94
96
EDGE MONO
S
R-S FLIP FLOP 98
R
TO 186
54
7-14 INPUT OR
92
98 LINES
88
PATTERN SELECT CONTROL
7 OF 98 DECODER
90
B.
SHORT POLY DECODE
104
105
LONG POLY DECODE
106
R-S FLIP FLOP 100
11 BIT POLY COUNTER
108
1 OF 32
84
32 LINES
PATTERN ROM
82
MASTER RESET
MASTER CK
MASTER RESET
126
124
C.
D.
32 LINES
32 LINES
32 LINES
122
1 OF 32
116
MINOR DIM DECODE
118
ROOT PULSER
120
32 OR
E.
134
56
MASTER RESET
78
80
68
2KD
1 KD
2 KD
5 BIT TRANSPARENT LATCH
ENABLE
58
MASTER RESET
5 BIT RHYTHM COUNTER
CK
34
MNPQR
ACC CHORD ENCODE
6
12 COUNTS FROM 1 OF 64
MASTER COUNTER DECODER
56
RHY CK
60
MASTER RESET
1 BIT SR 76
MASTER CK
RHY ON/OFF
62
64
ΔTEMPO
70
DUAL EDGE MONO
72
PATTERN ON/OFF
F.
COUNT 1
74
MASTER RESET
16
OFF
ON A.
B.
C.
D.
E.
F.
DIM FLAT ROM
MIN FLAT ROM
14 TO 1
1 OF 12
PATTERN SELECT CONTROL
BIT SR
MASTER CK
4 BIT LATCH
RESET
MASTER RESET
K02 K01
K03 K04
MPX DRIVERS
K05 K06
MPX DRIVERS
6 BIT DATA OUT
FLAT
ENABLE
BINARY
ADD ONE
4TH OCTAVE
3RD OCTAVE
2ND OCTAVE
TOP OCTAVE
12 BIT S-R
4-1 OCTAVE DECODER
12 TO 1 CHORD COMPONENT SELECTOR
46

METHOD AND APPARATUS FOR RHYTHMIC NOTE PATTERN GENERATION IN ELECTRONIC ORGANS

BACKGROUND OF THE INVENTION

The present invention relates to circuitry for generating rhythmic patterns of notes in electronic organs and in particular to organs wherein either or both the solo and accompaniment manuals are multiplexed.

Many features have been developed for integration into existing electronic organ circuitry, such as the automatic sounding of chords when a single key in the accompaniment manual is depressed, automatic rhythm units whereby a large number of percussion instruments can be simulated, and other features involving automatic note production. One example of an automatic note playing feature which is known is that of keying organ tones automatically to play the notes of a selected chord in a rhythmic pattern. This enables the player to play a selected accompaniment without the necessity for manually depressing all the keys which would normally be necessary. In some cases, the circuitry for generating the rhythmic pattern of tones is controlled by the rhythm unit so that the pattern is compatible with the percussion sounds which may be simultaneously produced by the rhythm unit.

As an increasing number of automatic note playing or percussion features are added to an organ, multiplexing of either or both of the solo and accompaniment keyboards becomes more attractive. Compatability of a rhythmic pattern note generator with multiplexing technology is therefore of primary concern from the standpoint of production cost and the ability to completely integrate the circuitry on as few chips as possible through LSI techniques.

SUMMARY OF THE INVENTION

The circuitry according to the present invention produces a rhythmic note pattern to supplement the notes generated by normal playing of the accompaniment and solo manuals which is related to the chord selected in the accompaniment manual, for example, by means of the depression of a single key which automatically generates a particular chord. The rhythm pattern is selected from a plurality of pre-programmed patterns and is synchronized with the rhythm clock so as to be coordinated with the percussion sounds generated by the rhythm unit. A control pulse is generated when the key in the highest octave corresponding to the root note of the selected chord is scanned by the solo manual multiplexer. This pulse is then selectively delayed in time until it coincides with a time slot which corresponds with the selected pattern which determines, for each of 32 rhythm clock pulses, the particular pitch and octave of the note which is to be sounded. In one mode of operation, the rhythmic note pattern data stream is impressed on the main data stream which is subsequently demultiplexed and enables selected keyers to pass the appropriate outputs of a tone generator to the voicing circuits.

Specifically, the present invention contemplates a method for producing rhythmic patterns of notes and circuitry therefor in an electronic organ including a solo manual, an accompaniment manual, a multiplexer which scans at least one of the manuals to produce a multiplexed data stream comprising respective time slots corresponding to successive keys of the scanned manual wherein key down signals appear in time slots corresponding to notes of depressed keys in the scanned keyboard, which comprises: producing an encoded chord signal in response to the depression of one or more keys in the accompaniment manual corresponding to a player selected chord which comprises data corresponding to the notes of the selected chord, storing in a memory data which represents a plurality of rhythmic patterns of musical intervals, calling forth a selected one of stored patterns one musical interval at a time, and generating a control pulse at a predetermined time in the scan of the manual delaying the control pulse by a number of successive time slots in the multiplexed data stream equaling the musical interval which is called forth, and then placing the control pulse on the data stream.

In an alternative mode of operation, it may be desirable to provide separate voicing for the rhythmic note pattern which necessitates separate demultiplexing of the main and rhythmic note pattern data streams. In this case, the time division multiplexed rhythmic note pattern data stream is converted to a six bit word which in turn is multiplexed separately from the main data stream in a pitch and octave format, for example, and then passed to a demultiplexer and tone generation circuit.

The multiplexer for accomplishing this comprises: a serial data input, a plurality of latches including respective input terminals connected in parallel to the data input and respective clocking inputs and respective output terminals, multiplexer driver means connected to the latch clocking inputs for sequentially clocking the latches to transfer the data signals on their respective input terminals to their respective output terminals, and a tone selector connected to at least some of the output terminals, and to the tone sources, the selector having an output and means for placing selected ones of the tones on its output in response to data signals on the latch output terminals connected thereto.

It is an object of the present invention to provide rhythmic note pattern circuitry wherein a control pulse corresponding to the root tone of the selected accompaniment chord is selectively delayed in time until it coincides with a time slot corresponding to a desired pitch and octave in the solo manual according to a preselected rhythmic and tone pattern.

It is a further object of the present invention to provide rhythmic note pattern circuitry capable of being integrated into a multiplexed organ.

A still further object of the present invention is to provide rhythmic note pattern circuitry for the automatic playing of note patterns, especially in the solo voices, which can readily be produced by a single LSI chip.

Another object of the present invention is to provide circuitry wherein rhythmic note patterns can be voiced separately from the notes generated directly by the solo and accompaniment manuals.

Yet another object of the present invention is to provide rhythmic note pattern circuitry which is particularly adapted for use with electronic organs of the type which employ multiplexing for automatically playing fill notes in the solo manual.

These and other objects of the present invention will be apparent from the following description taken in conjunction with the accompanying drawings.

BRIEF DESCRIPTION OF THE DRAWINGS

FIGS. 3*a* and 3*b* together constitute a more detailed schematic representation of the rhythmic note pattern circuit according to the present invention.

DETAILED DESCRIPTION

Figure 1:
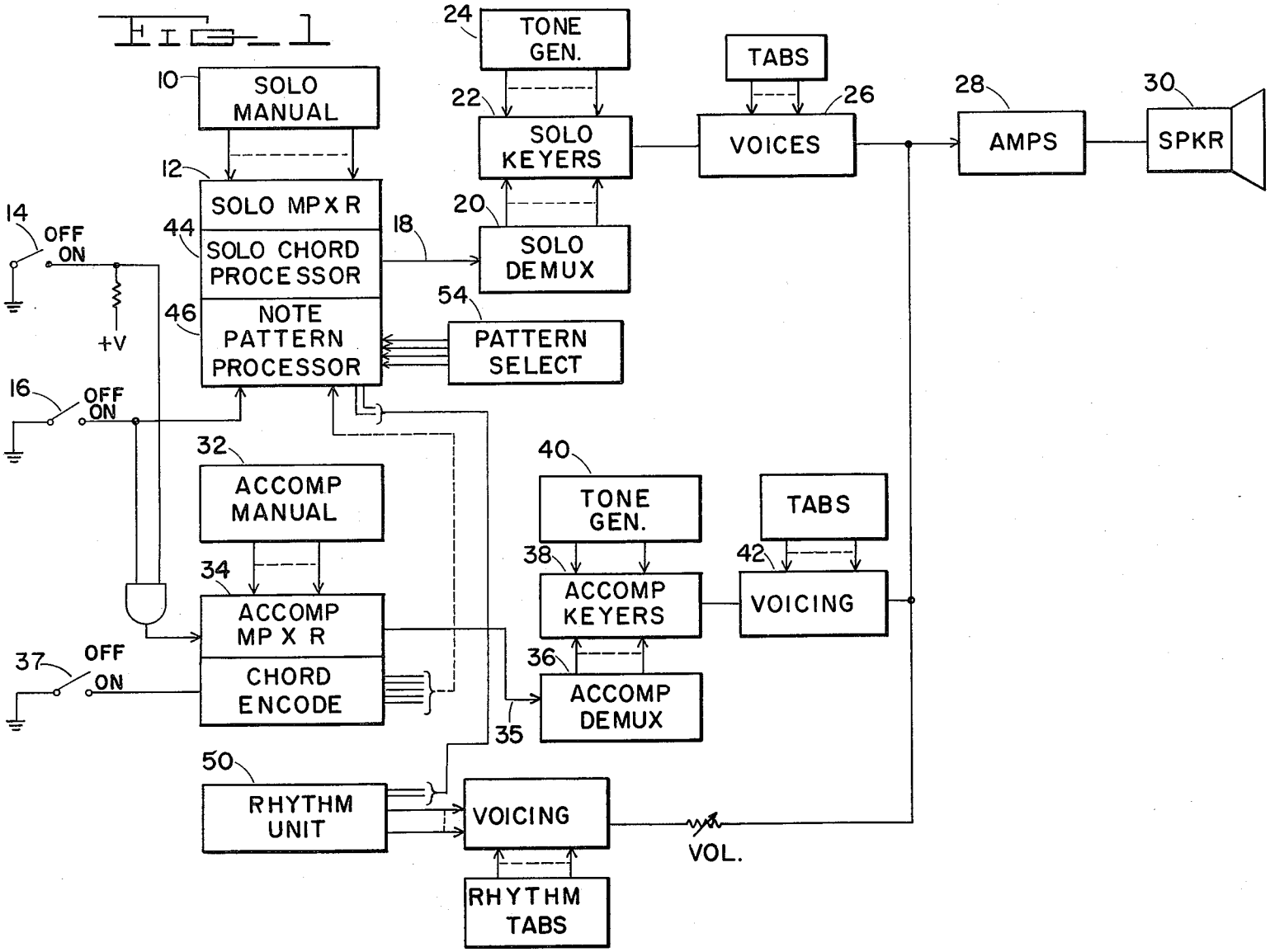
FIG. 1 is a block diagram of an organ circuit incorporating the circuit of the present invention.
Figure 2:
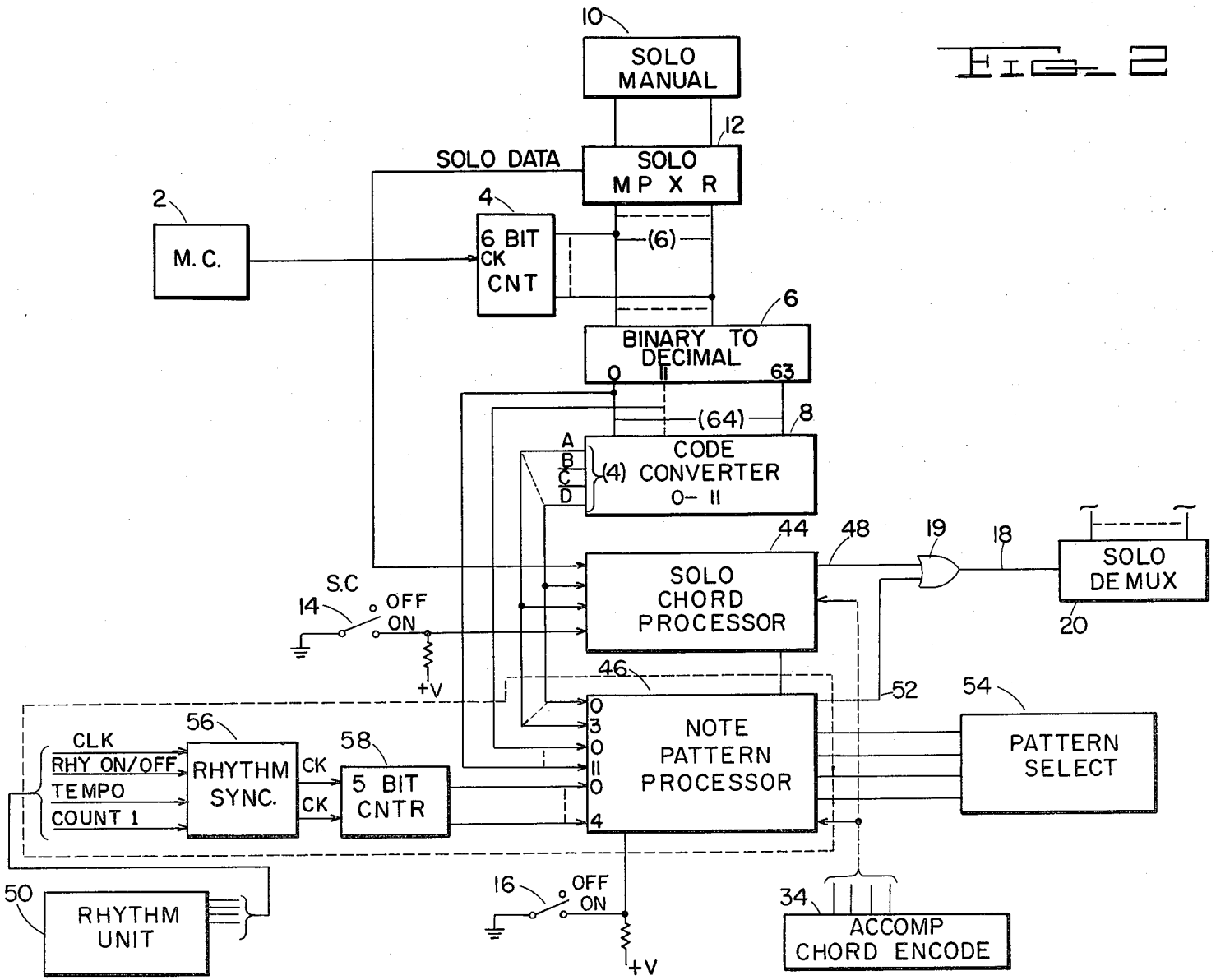
FIG. 2 is a somewhat more detailed block diagram incorporating the circuit of the present invention.

With reference to FIGS. 1 and 2 of the drawings, solo manual 10 is multiplexed in a conventional manner by solo multiplexer 12 as, for example, described in U.S. Pat. No. 3,990,339 owned by the assignee herein. When solo chord switch 14 and note pattern switch 16 are switched OFF, the output of multiplexer 12 is directed to output lead 18. Lead 18 connects the time division multiplexed data stream output of the solo manual 10 to the solo manual demultiplexer 20, which enables appropriate ones of solo keyers 22 to connect appropriate outputs of tone generator 24 to voicing circuits 26, amplifier means 28 and speaker 30.

Accompaniment manual 32 which is either a separate keyboard or the portion of a single keyboard which is customarily played by the left hand, may also be multiplexed by mutiplexer/chord encoder 34. With switches 14 and 16 and auto-chord switch 37 switched OFF, multiplexer/encoder 34 will scan accompaniment manual 32 to develop a data stream on lead 35, which is connected to accompaniment demultiplexer 36. In a similar fashion to solo demultiplexer 20, accompaniment demultiplexer 36 enables selected ones of accompaniment keyers 38 to connect appropriate outputs of tone generator 40 to voicing circuit 42, which passes the voiced signals to output amplifier means 28 and speaker 30.

Whenever any one of switches 14, 16 or 37 are switched ON, multiplexer/encoder 34 will be disabled for developing the normal data stream on wire 35 corresponding to the depression of individual keys and, instead, the encoding portion of multiplexer/encoder 34 will be enabled to develop a five bit binary chord word when a single one of a predetermined group of chord playing keys, for example thirty-one keys, is depressed. In this automatic chord mode, an alternate data stream containing key down signals in time slots corresponding to notes of the selected chord is generated by multiplexer/encoder 34 and placed on wire 35. This enables the playing of one of a number of selected chords merely by the depression of the appropriate control key.

With either switch 14 or 16 switched ON, the data stream from solo multiplexer 12 is supplemented with solo chord or note pattern data from either the solo chord processor 44 or the note pattern processor 46 which develops an alternate data stream that is supplied to wire 18 via OR gate 19, as shown in FIG. 2.

The solo chord processor 44 is a known circuit which is disclosed in detail in U.S. Pat. No. 3,990,339 and will therefore be discussed only briefly herein. In operation, processor 44 will pass the normal output of multiplexer 12, consisting of key down signals in time slots corresponding to notes normally produced by the depression of one or more keys in the solo manual, to an output line 48 when switch 14 is in the OFF position. When switch 14 is switched ON, processor 44 receives additional inputs from accompaniment multiplexer/encoder 34 relating to the notes of a selected chord and will produce a data stream which contains key down signals in time slots corresponding to notes of the chord selected by the chord playing key of the accompaniment manual 32 in the octave just below the highest note played in the solo manual 10. The key down signals which are produced by processor 44 in this mode of operation are called fill-in notes which sound in the solo part of a composition and are harmonically consistent with the solo notes and with the accompaniment chords.

A second processor 46, which is referred to as a note pattern processor, will disable the output of solo chord processor 44 whenever switch 16 is switched ON, and will develop a data stream at output terminal 52, shown in FIG. 2. Note pattern processor 46 receives additional inputs from multiplexer/encoder 34, rhythm unit 50, and pattern select control circuit 54. The data stream developed by processor 46 consists of a key down signal which will change from key to key in accordance with a selected pattern in response to pulses from rhythm unit 50, thus producing a rhythmic note pattern in the solo voices.

As described above, the solo multiplexer 12, solo chord processor 44 and pattern processor 46 provide the capability of playing standard solo notes which correspond to depressed keys in the solo manual, solo fill notes, or solo rhythmic note patterns, respectively. The remainder of the description will be concerned primarily with the pattern processor 46 and its interconnection with processor 44, multiplexer/encoder 34 and rhythm unit 50.

With particular reference to FIG. 2, the connections between the solo manual circuit devices are shown. A master clock 2 produces high frequency clock pulses to drive a six bit counter 4, which in turn drives multiplexer 12 and binary to decimal converter circuit 6. Converter 6 is a 6 line to 1 of 64 line decoder, enabling each of sixty-four output lines sequentially as counter 4 cycles through the six bit count. The outputs of converter 6 are connected to the inputs of a code converter 8 which produces a four bit output that cycles through counts zero through eleven five times as the outputs of circuit 6 change from zero through sixty, and holds an output of count twelve during outputs sixty-one, sixty-two, and sixty-three of circuit 6. The output of converter 8 is connected to form inputs to both solo chord processor 44 and note pattern processor 46.

Rhythm unit 50, in addition to supplying appropriate output signals to rhythm voicing circuits (not shown) for the production of percussion sounds, supplies four output signals to a rhythm synchronizer block 56 as will be described in greater detail hereinafter. Block 56, in turn, provides clock and clear signals to five bit counter 58 which in turn produces a five bit rhythm count word. Counter 58 and synchronizer block 56 provide a rhythm count for note pattern processor 46.

Figure 3B:
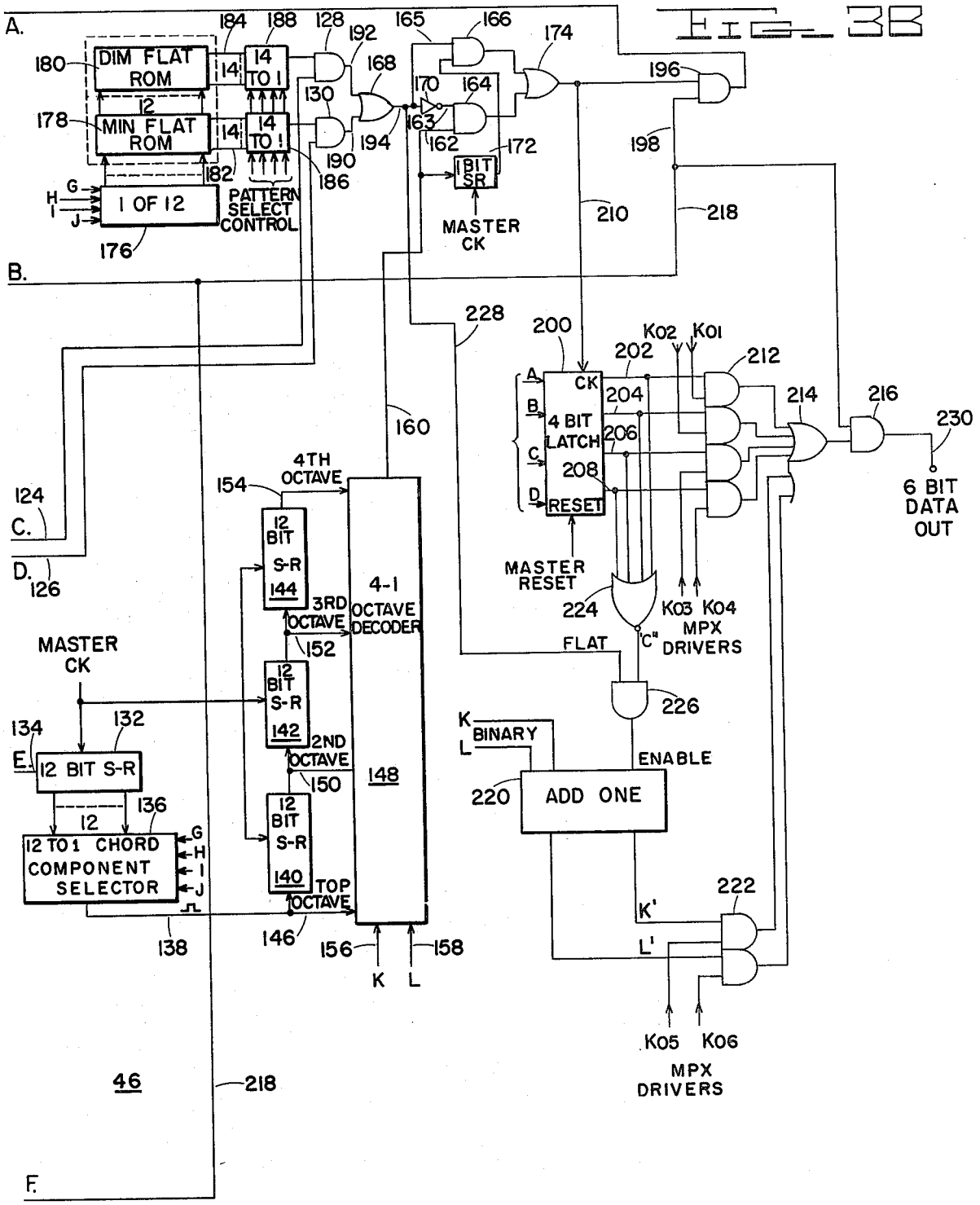

Referring now to FIG. 3, the details of note pattern processor 46 will be discussed. Rhythm unit 50 provides rhythm pulses on lead 60 of rhythm synchronizer unit 56 at a very low frequency, for example 0.5–10 Hz. In the present example, a rhythm cycle consisting of 32 pulses has been selected so that input lead 60 of synchronizer block 56 will see a pulse in each of the 32 rhythm cycle time slots. A rhythm ON/OFF signal from rhythm unit 50 will be present on lead 62 and, depending on its logic level, will trigger R-S flip flop 64 to enable five bit transparent latch 66 through AND gate 68. A tempo change signal from rhythm unit 50 on synchronizer lead 70, for example, a change from $\frac{3}{4}$ time to 4/4 time, will trigger dual edge monostable multivibrator 72 which triggers R-S flip flop 64 to disable latch 66 until a Count 1 signal is received on lead 74 which again triggers flip flop 64 to enable latch 66. A 1-bit shift register 76, which is clocked at a very high rate by the master clock 2, provides a slight delay to assure proper resetting of five bit rhythm counter 58.

In general terms, synchronizer 56 ensures that the internal five bit counter 58 will not lose step with the counter of rhythm unit 50. The second input for AND gate 68 comprises OR gate 78 which produces an appropriate logic level on line 80 whenever two or more keys in the accompaniment manual are depressed simultaneously. Due to the particular chord coding technique which is utilized, the depression of one or more accompaniment keys would result in the selection of incorrect chord notes. To prevent this occurrence, latch 66 is disabled thereby blocking the passage of rhythm counts from counter 58.

Read only memory (ROM) 82 is addressed by 1 of 32 decoder 84 which in turn is addressed by rhythm counter 58 through latch 66. ROM 82 has a 98 line output consisting of fourteen sets of seven lines each thereby having a capacity of fourteen different note patterns. Each of these fourteen patterns are addressed simultaneously by decoder 84 for each of the thirty-two successive "beats" of the rhythm cycle and provides simultaneously fourteen seven bit words for each of the rhythm beats at its output 86.

One seven bit set of the fourteen outputs is selected by pattern select circuit 88 to form a seven bit output word for each of the thirty-two counts from counter 58. Pattern select circuit 88 comprises a 7 of 98 decoder 90 which is controlled by pattern select control 54 and seven 14-input OR gates 92. OR gates 92 have respectively seven output lines labeled G, H, I, J, K, L and STRIKE. Output lines G, H, I and J form a four bit pitch select word and output lines K and L form a two bit octave select word, while the seventh output STRIKE is provided to select any of the thirty-two counts from counter 58 which will be utilized to enable the STRIKE output circuitry. Depending on the pattern selected by control 54, the output word of pattern select circuit 88 for each of the thirty-two beats will be a signal corresponding to a particular interval from the root note of the selected chord.

The strike output line 94 triggers an edge triggered monostable multivibrator 96 which sets R-S flip flops 98 and 100. Flip flop 98 provides a STRIKE output on line 102 and is reset after a short time interval by short polynomial decoder 104. Flip flop 100 provides an enable command on line 105 and is reset after a long time interval by long polynomial decoder 106. Decoders 104 and 106 decode the output of an eleven bit polynomial counter 108. Once reset, the output of flip flop 100 disables clock signals from polynomial counter 108 until a new strike pulse is developed by multivibrator 96.

The output line 105 of flip flop 100 forms one input of AND gate 110, the second input of which is the serial data stream from AND gate 112, the latter being enabled when switch 111 is in the ON position. When the output of flip flop 100 is logic 1, AND gate 110 will pass the serial data to output line 114. By programming long polynomial decoder 106 for the desired time interval, each time a strike command is present on line 94, a burst of key down signals will be present on data output line 114 for the selected interval. The STRIKE information on line 102, the time duration interval of which is determined by the programming for short polynomial decoder 104, is utilized when separate voicing is desired for the pattern notes. This feature will be described in greater detail at a later point.

The root note generation circuitry comprises a 1 of 32 decoder 116 which is addressed by the five bit output of accompaniment chord encoder 34, a minor/diminished chord decoder ROM 118, a root pulser ROM 120 and a 32-input OR gate 122. Decoder 116 selects one line of ROM 118 in accordance with the five bit word from accompaniment encoder 34 and one of the output lines 124 or 126 of ROM 118 is switched to logic 1 when a diminished or minor chord word, respectively, appears at the output of decoder 34. Lines 124 and 126 are connected to the inputs of AND gates 128 and 130, respectively.

Root pulser 120 comprises twelve column select inputs taken from the top octave input lines from binary to decimal decoder 6, with each terminal corresponding to one of the top twelve keys of the solo manual 10. Each of the thirty-two lines of ROM 120 is programmed to produce a particular output when the column select input corresponding to the selected chord is pulsed. Each chord will have a particular root or reference note and the ROM 120 output is in the form of a pulse corresponding to the time slot of this note in the highest octave of the solo manual 10 which is fed to twelve bit shift register 132 through OR gate 122. For example, if a C major chord is selected on the accompaniment manual, root pulser 120 will provide a pulse on the input line 134 to shift register 132 in the first time slot of the solo manual scan. This is the time slot in which the C key in the solo manual, which is the root tone of the C major chord, is addressed.

Thus, the programmed circuit comprising ROMS 118 and 120 provides two outputs, one indicating whether a minor or diminished chord is being selected, and the second consisting of a single pulse during the time period when solo manual multiplexer 12 is scanning the note in the upper octave of the solo keyboard 10 which corresponds to the base or root note of the selected chord.

Considering first the output from root pulser 120, the twelve output bits of shift register 132 are connected to a 12 line to 1 line data selector 136. Selector 136 is controlled by outputs G, H, I and J of pattern select circuit 88 and functions to delay the pulse produced by root pulser 120 in accordance with the four bit pitch interval word produced by pattern select circuit 88. Decoder 136 produces an output pulse on line 138 which is simply the input pulse on line 134 delayed by the time interval called for by the pattern selected by pattern control 54. For example, if the control pulse corresponds to the highest octave C and the pattern selected by pattern ROM 82 calls for a note which is six halftones below the root note, the C pulse will be delayed by six time slots so that the pulse produced on output line 138 will correspond to F# in the highest octave.

The pulse on line 138 is then shifted successively through three twelve bit shift registers 140, 142 and 144 and simultaneously placed on input line 146 of 4 to 1 decoder 148. The other inputs 150, 152 and 154 to decoder 148 are connected to the outputs of shift registers 140, 142 and 144, respectively.

Output lines K and L of pattern select circuit 88 provide the other set of inputs 156 and 158 of decoder 148. The particular two bit word on lines 156 and 158 determines which of the input lines 146, 150, 152 or 154 are selected by decoder 148 for connection to output line 160. As indicated earlier, output lines K and L contain octave information and function to delay the pitch delayed pulse on line 138 by one, two or three octaves before placing the pulse on output line 160 or to provide its output pulse without any delay whatsoever. By selectively providing delay to the highest octave root note, a pulse corresponding to the time slot of any key in the solo manual 10 may be provided on line 160 in accordance with the thirty-two step pattern selected from ROM 82. This output pulse is connected to input 162 of AND gate 164.

The second input 163 to AND gate 164 and one of the inputs 165 to AND gate 166 are connected to the output of OR gate 168. When the output of OR gate 168 is at logic 0, AND gate 164 will be enabled to pass output pulses from octave decoder 148, due to the inverting function of inverter 170. When the output of OR gate 168 goes high, on the other hand, AND gate 164 will be disabled and AND gate 166 will pass the output of one bit shift register 172. By delaying the output pulse on 160 by one time slot, the note value thereof is dropped a half tone in pitch, ie. flatted. Thus, the output of OR gate 174 is either the note corresponding to the output pulse on line 160 or that note flatted by a half tone depending on the outputs present on line 124 and 126 leading from minor/diminished ROM 118.

Output lines G, H, I and J of ROM 82 control the selection of one of twelve lines in 1 of 12 decoder 176, which in turn addresses minor chord ROM 178 and diminished chord ROM 180. Each line of ROMS 178 and 180 consists of two fourteen bit outputs, 182 and 184, respectively, which correspond to minor and diminished chords. That is, each of the outputs 182 and 184 have one line for each of the fourteen possible patterns selected by pattern control circuit 54. The four inputs G, H, I and J to decoder 176 from pattern select circuit 88 correspond to a particular point in each pattern, and ROMS 178 and 180 provide the ability to select certain points of each pattern to be flatted if a minor or diminished chord is selected.

The fourteen bit outputs 182 and 184 from ROMS 178 and 180 are connected respectively to 14 to 1 line selectors 186 and 188, which are controlled by the four bit pattern control word from pattern select control 54. The outputs of line selectors 186 and 188 constitute the other inputs for AND gates 130 and 128, respectively. Thus, a pair of flatting control signals, which can be programmed to develop a flatting signal for any amount of delay for any of the patterns, are produced on lines 190 and 192 and are passed to the second inputs 163 and 165 of AND gates 164 and 166 through OR gate 168. Thus, if a flatting signal is present on the output line 194 for OR gate 168, the pitch and octave pulse on line 160 will be delayed by one time slot at the output of OR gate 174 due to the enabling of AND gate 166 and the disabling of AND gate 164. If no pulse is present on line 194, AND gate 164 will be enabled and pass the pulse on line 160 directly to OR gate 174, and AND gate 166 will be disabled.

The output of OR gate 174 is passed through AND gate 196 when enabled by a pattern ON signal on the other input line 198 to AND gate 196. This data is similarly passed by AND gate 112 and gated in conjunction with the strike pulse on line 105 by AND gate 110 to note pattern data output line 114. This data stream consists of key down signals in time slots corresponding to a pattern of notes which sound in synchronism with selected ones of the thirty-two rhythm beats that are provided by rhythm counter 58.

In some cases, it may be desirable to provide separate voicing for the pattern notes and it therefore becomes expedient to maintain the note pattern data separate from the solo data in order to demultiplex this data outside the main LSI chip. This affords considerable flexibility in including this as an optional feature in organ design without the necessity for including separate demultiplexing circuitry in the main chip.

In order to provide separate multiplexing, the data stream developed at OR gate 174 is connected to the clocking input of a four bit latch 200 which produces a four bit output on lines 202, 204, 206 and 208 corresponding to the note name of the four bit pitch word which is simultaneously present on lines A, B, C and D from code converter 8. It will be recalled that code converter 8 provides a four bit output which cycles from 1 through 12 as each of the octaves are scanned. Since the pulse on line 210 is synchronized with the octave being scanned, the original four bit code for that pitch will be provided at the inputs of AND gates 212. The other inputs for AND gates 212 are connected with the multiplex drivers $K_{01}$ through $K_{04}$ of the solo multiplexer 12. The outputs of AND gates 212 are connected through OR gate 214 to one input of AND gate 216, the other input of which is connected to the pattern ON/OFF control line 218.

The K and L outputs from pattern select circuit 88 pass through ADD 1 circuit 220 to one set of inputs for AND gates 222. The other inputs for AND gates 222 are drivers $K_{05}$ and $K_{06}$ and the outputs thereof are connected to OR gate 214. The output of AND gate 216, therefore, is a serial data stream of six bit pitch and octave encoded data words.

The outputs 202, 204, 206 and 208 of latch 200 are connected to NOR gate 224 which produces a logic 1 pulse whenever a C note (logic 0000) is latched in. The output of NOR gate 224 is anded in AND gate 226 with the output of OR gate 168, which, as will be recalled, may carry a flatting pulse if a minor or diminished chord is selected. In order to prevent the flatted C#, which is a C natural, from wrapping around and playing in the high end of the same octave, it is necessary that the octave change so that it plays at the high end of the next lower octave. To accomplish this, when the output of OR gate 224 is at a logic 1 level and a flatting pulse is present on line 228, circuit 220 will be enabled so as to add one bit to the two bit binary word on the K and L inputs. This results in the octave information being shifted one octave lower.

The output of OR gate 214, therefore, develops a serial six bit word which uniquely defines the note selected by the pattern generation circuitry. This six bit data stream is present on output line 230 of AND gate 216 when the pattern ON/OFF switch 16 is ON.

Figure 4:
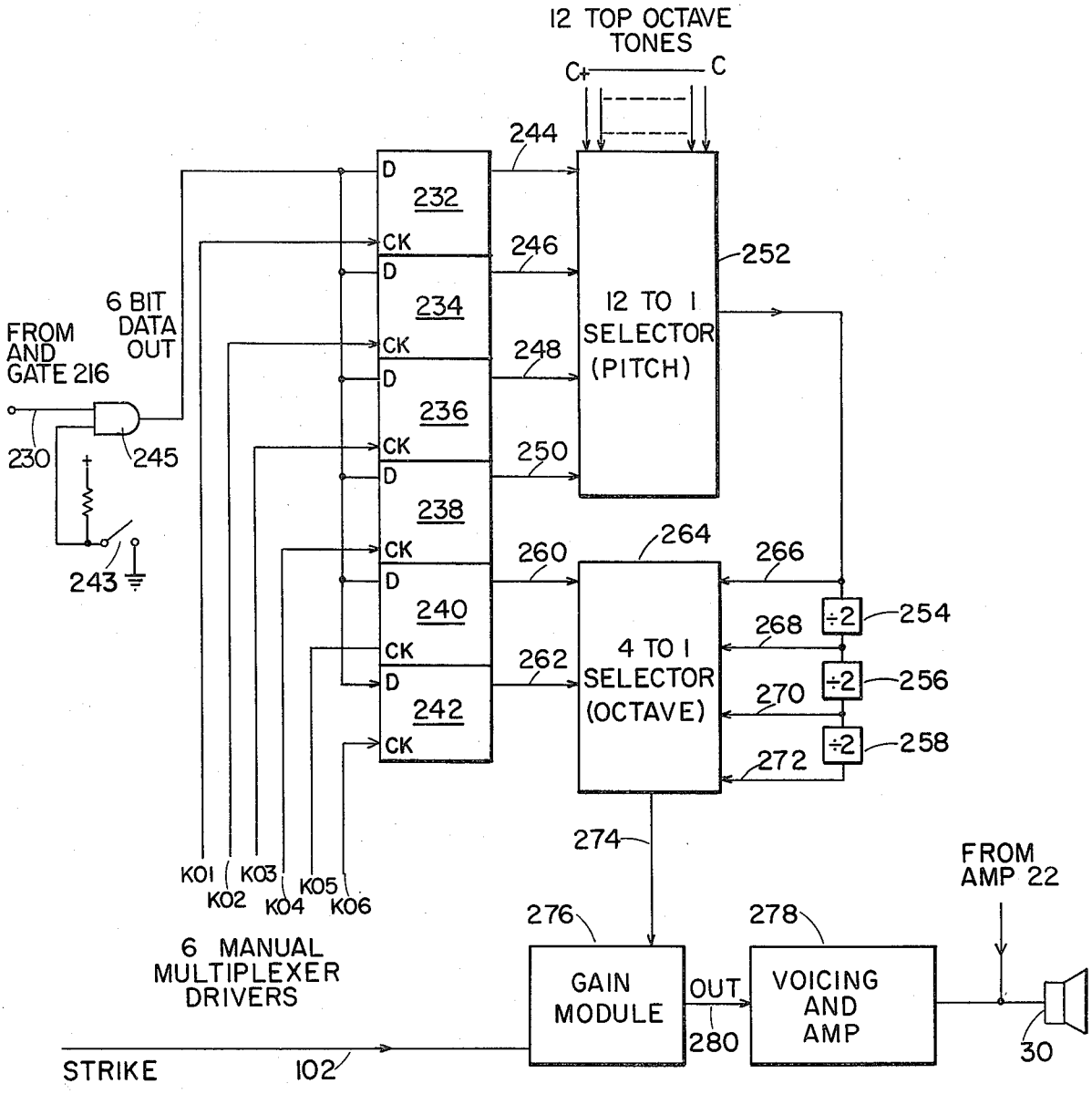
FIG. 4 is schematic representation of the demultiplexing circuit according to one aspect of the present invention.

Referring now to FIG. 4, the circuitry for demultiplexing the serial data stream on line 230 and for keying the appropriate tone will be described. The six bit data stream passes to the inputs of six D type latches 232, 234, 236, 238, 240 and 242 through AND gate 245. Latches 232 through 242 are latched in succession by the multiplexer drivers $K_{01}$ through $K_{06}$ for solo multiplexer 12, which are the same drivers that are driving the AND gates 212 and 222 which initially formed the six bit word. The outputs of latches 232 through 242 will update one at a time rather than simultaneously. The high rate at which the multiplexer is running renders this update time negligible.

The outputs 244, 246, 248 and 250 of the first four latches 232, 234, 236 and 238, respectively, drive a 12 to 1 selector 252. The other inputs of selector 252 are the 12 top octave tones which may be in square wave form. The selected pitch goes down through a series of divide-by-two dividers 254, 256 and 258, each of which drops the pitch of the selected tone by one octave. The particular octave corresponding to the six bit word on line 230 is determined by the two bit word on the outputs 260 and 262 of latches 240 and 242, respectively. Depending on the two bit input word, selector 264 will connect one of the inputs 266, 268, 270 or 272 to its output line 274.

The output 274 of 4 to 1 selector 264 is a tone which is the result of the pitch and octave information and is gated by gain module 276. When a strike command is present on line 102 from flip flop 98, gain module 276 will pass the signal on line 274 to the amplification and voicing circuits 278. When no strike command is present, however, the gain of module 276 is decreased so that no signal is provided on its output 280. Gain module 276 could comprise any common sustain organ keyer.

To illustrate the manner in which the note pattern processor operates, a very simple pattern will be traced through the system. Assume that a C minor chord is selected and that the desired pattern selected from pattern ROM 82 comprises: the root tone (C natural) in the second octave below the highest octave of the solo manual which is played on the first beat of the rhythm measure, the third of the C minor triad (E flat) played on the sixteenth beat of the rhythm measure and the fifth of the C minor triad (G natural) played on the thirty-second beat of the rhythm measure.

When rhythm counter 58 counts "1", logic 0000 will be passed by transparent latch 66 into 1 of 32 decoder 84, which in turn addresses the first line of pattern ROM 82. ROM 82 provides 14 seven bit words at its output 86 into 7 of 98 decoder 90. With pattern select control circuit 54 set to select the pattern described above, decoder 90 will provide a 7 bit word to OR gates 92 containing pitch, octave and strike information on lines G, H, I, J, K, L and STRIKE line 94. Because of the pattern selected, lines G, H, I and J will correspond to a pitch shift of zero and lines K and L will correspond to an octave shift of two octaves. Assume that voicing is common to both the main data stream and pattern data stream so that the strike command information will be gated through AND gate 110.

Since the chord selected is a minor chord, minor/diminished ROM 118 will provide a logic level one output on line 126. Since the root tone of the C minor chord is not flatted, however, ROM 178 and decoder 186 provide a logic 0 to AND gate 130 and no flatting signal will appear on line 194.

Root pulser ROM 120 is programmed such that when the line from 1 of 32 decoder 116 corresponding decoder to the C minor chord is pulsed, an output pulse on line 134 in the time slot for the note C in the highest octave is present. This will occur in the first time slot of the scan. The pitch information on lines G, H, I and J from pattern select circuit 88 will provide a pulse on line 138 without delay. It will be recalled that in the selected pattern, the tone on the first beat of the thirty-two beat rhythm measure is to be the root tone. This pulse will pass through shift registers 140 and 142 so as to be delayed two octave length intervals by 4 to 1 decoder 148 before an output pulse is provided on line 160. The pulse on line 160 will accordingly correspond to the C key in the second octave below the highest octave of the solo manual 10.

Because no flatting pulse is present on line 194, AND gate 166 is disabled and AND gate 164 is enabled thereby passing the pulse to OR gate 174 from there through AND gates 196 and 112 whereupon it is gated onto note pattern data line 52 by a strike pulse on input 105 of AND gate 110. This data stream will be added to the main data stream from solo chord processor 44 at OR gate 19 and from there it will be fed to the solo demultiplexer 20.

On the second rhythm beat of the thirty-two beat rhythm measure, the selected pattern will indicate that no note is to be played and will place a logic 0 on STRIKE line 94. Thus, flip flop 100 will not be set and AND gate 110 will therefore not be enabled to pass any note pattern data to line 52. This condition will remain in effect until the sixteenth beat.

At this point, decoder 84 will address the sixteenth line of pattern ROM 82 and 7 of 98 decoder 90 will provide a pattern word on lines G through L corresponding to the third of the selected triad in its major key. This will be the root note shifted down in pitch by eight halftones and shifted downward one octave. Shift register 132 and twelve to one decoder 136 will delay the root tone for C in the highest octave by eight time slots so that it corresponds to E in the next highest octave and provides a pulse on line 138 in this time slot. Octave information on lines 156 and 158 of 4 to 1 decoder 148 control decoder 148 to produce a pulse on output line 160 after the E pulse is shifted through register 140.

Since this is a minor chord, logic level one will be present on both inputs to AND gate 130 thereby causing a flatting pulse to be present on line 194. This disables AND gate 164 and enables AND gate 166 so that the E pulse will be delayed one bit by shift register 172 before being passed by OR gate 174. The output pulse from OR gate 174 will therefore correspond to an E flat in the second octave below the highest octave of the solo manual 10 and will occur on the sixteenth beat of the rhythm measure.

For rhythm beats seventeen through thirty-one, no strike pulse will be provided on line 94 so that AND gate 110 will be disabled. On the thirty-second rhythm beat, however, the thirty-second line of the pattern ROM 82 will be addressed by decoder 84 and decoder 90 will pass the seven bit word corresponding to the selected pattern to the output of OR gates 92. It will be recalled that the selected pattern called for the fifth of the selected triad to be played on the thirty-second rhythm beat and in a fashion similar to the preceeding two notes which are played, and output pulse will be provided on line 38 which corresponds to the root tone delayed by five bits. In this case, this will correspond to the G key in the highest octave of manual 10.

The octave information on lines 156 and 158 will cause 4 to 1 decoder 148 to provide an output pulse on line 160 after the G pulse on line 138 has passed through the first shift register 140. No flatting pulse will be present on line 194 and the C pulse will therefore pass through AND gate 164 to the output of OR gate 174 and from there through AND gates 112 and 110 to note pattern data output line 52.

On the first rhythm beat of the next rhythm measure, which is on the next clock pulse for counter 58, the pattern described above will be repeated. This will continue until the selected chord is changed, the pattern is altered or switch 16 is opened.

In the example described above, the note pattern data is demultiplexed together with the main data. If it is desired to voice the note pattern data separately from the solo manual data, switch 243 (FIG. 4) will be closed to enable AND gate 245 and switch 111 (FIG. 3) will be opened to disable AND gate 112.

Although the six bit word on line 230 is shown as being multiplexed out in pitch and octave format, it could also be multiplexed out in a 1 of 64 tone format. Furthermore, the use of a five bit counter, five bit lower manual chord word, and fourteen patterns are not limiting factors. For example, suitable decoding of the chord selected in the accompaniment manual would allow any chord to be played by depressing the keys of the notes forming the chord. A simple variation would be to place note pattern data out into an accompaniment demultiplexer so that even though the data is processed in a solo LSI, it can play through the accompaniment demultiplexer and voicing. Also, by using the six bit word output, it could be connected to a simple or even complex synthesizer.

A variation on the twelve bit shift register per octave method is a two bit binary counter counting multiplexer octaves and being compared with the desired octave two bit word with exclusive OR gates. The root pulser would be required to pulse in every octave and would only be enabled during a match between the two bit octave counter and the desired octave. An extension of the range of the octaves which are playable can be attained by a larger binary octave control word and more twelve bit shift registers, or a longer octave counter.

While this invention has been described as having a preferred design, it will be understood that it is capable of further modification. This application is, therefore, intended to cover any variations, uses or adaptations of the invention following the general principles thereof and falling within the scope of the appended claims.

What is claimed is:

1. In an electronic organ including a solo manual, an accompaniment manual, and means for scanning at least one of said manuals to produce a multiplexed data stream comprising respective time slots corresponding to successive keys of the scanned manual wherein key down signals appear in respective time slots corresponding to notes of depressed keys of the scanned manual, rhythmic note pattern generation circuitry comprising:

chord encode means for producing an encoded chord signal in response to the depression of one or more keys in the accompaniment manual corresponding to a player selected chord, said chord signal containing data corresponding to the notes of the selected chord, memory means for storing data representative of a plurality of rhythmic patterns of musical intervals, address means for addressing said memory means to select one of said patterns and for providing at an interval output musical interval signals corresponding to the musical intervals of the selected pattern, said musical interval signals being provided one at a time at a rhythmic rate much slower than the rate at which said one manual is scanned, each of said musical interval signals being a multiple bit binary word wherein one group of bits in the word corresponds to a pitch interval and the remaining group of bits corresponds to an octave interval, and data generating means corresponding to said encoded chord signal and to the musical interval signal at said interval output for producing a control pulse at a predetermined time in the scanning of said one manual and for delaying said control pulse by a number of successive time slots in said multiplexed data stream determined by the pitch interval bits of the musical interval signal at the interval output and by a number of octave length groups of time slots determined by the octave interval bits of the musical interval signal at the interval output.

2. The organ of claim 1 wherein said address means includes: rhythm generating means for producing successive signals at a rate much slower than the rate at which said one manual is scanned, and means whereby the musical interval signals for the selected pattern are produced in synchronism with said rhythm generating means.

3. The electronic organ of claim 2 wherein said memory means comprises a read only memory having a plurality of input lines each common to all of the rhythmic patterns stored therein and said address means scans said input lines in synchronism with said rhythm generating means and at the rate thereof.

4. The electronic organ of claim 2 wherein said address means includes means whereby the musical interval signals for the selected pattern are repetitively produced in succession.

5. The electronic organ of claim 1 wherein: said scanned manual is the solo manual, and said data generating means includes root pulser means for producing said control pulse simultaneously with the time slot in said multiplexed data stream corresponding to the root note of the selected chord in the highest octave of said solo manual.

6. The electronic organ of claim 5 wherein said means for scanning includes counter means for producing at the output thereof a stream of binary words corresponding to respective keys of said solo manual and wherein said root pulser is synchronized with said counter means for at least a portion of the scan of said solo manual.

7. The electronic organ of claim 1 including flatting means responsive to said encoded chord signal and said musical interval signal for selectively further delaying said control pulse one additional time slot when minor and diminished chords are selected by the player.

8. The organ of claim 1 including means for placing said delayed pulse on said data stream in synchronization with said data stream.

9. In an electronic organ including tone generator means, transducer means, keyers connecting the generator means with the transducer means, playing keys, multiplexer means for scanning the keys sequentially, and demultiplexer means responsive to time division multiplexed binary data supplied thereto to actuate the keyers, rhythmic note pattern circuitry comprising:

memory means having a plurality of rhythmic note patterns stored therein, address means for addressing said memory means to select one of said patterns and produce in succession a plurality of binary words at a rhythmic rate much slower than the rate at which the keys are scanned, each of said binary words comprising one group of bits corresponding to a pitch interval and the remaining group of bits corresponding to an octave interval, root pulser means for cyclically producing a data pulse at a predetermined time in the scan of said keys, and delay means controlled by said address means and said root pulser means for receiving said binary words from said address means and for delaying said control pulse by the pitch interval bits of the binary word received from said address means and by the octave interval bits of the binary word received from the address means, and then transmitting said data pulse to said demultiplexer means.

10. The electronic organ of claim 9 wherein said root pulse means includes an output at which said data pulse is produced, and said delay means comprises:

a first shift register means connected to said root pulser means output and connected to receive one of said octave interval group of bits and said pitch interval group of bits of the binary word produced by said address means, said first shift register means including an output and means for delaying said data pulse an interval of time determined by the said bits of said binary word received thereby before placing said data pulse on its output, a second shift register means having an input connected to said first shift register means output and connected to receive the other of said octave interval group of bits and said pitch interval group of bits of the binary word produced by said addres means, said second shift register means including means for further delaying said data pulse an interval of time determined by the bits of said binary word received thereby before transmitting said data pulse to said demultiplexer means.

11. The electronic organ of claim 10 wherein: said playing keys are arranged in octaves, said multiplexer means scans said octaves in succession, said pitch interval is less than the scan of an octave by said multiplexer means, and the octave interval is an integer multiple of the scan of one octave by said multiplexer means.

12. The electronic organ of claim 10 including flatting means interposed between said second shift register means and said demultiplexer means for selectively delaying said data pulse by a time interval equal to the scan of one key by said multiplexer means.

13. In an electronic organ including a solo manual, an accompaniment manual, and means for scanning at least one of said manuals to produce a first multiplexed data stream comprising respective time slots corresponding to successive keys of the scanned manual wherein key down signals appear in respective time slots corresponding to notes of depressed keys of the scanned manual, rhythmic note pattern circuitry comprising:

chord encode means for producing an encoded chord signal in response to the depression of one or more keys in the accompaniment manual corresponding to a player selected chord, said chord signal containing data corresponding to the notes of the selected chord, memory means for storing data representative of a plurality of rhythmic patterns of musical intervals, address means for addressing said memory means to select one of said patterns and for producing at an output musical interval signals corresponding to the musical intervals of the selected pattern, said musical interval signals being provided one at a time, each of said musical interval signals being a multiple bit binary word wherein one group of bits in the word corresponds to a pitch interval and the remaining group of bits corresponds to an octave interval, data generating means responsive to said encoded chord signal and to the musical interval signal at said address means output for producing a control pulse at a predetermined time in the scanning of said one manual and for delaying said control pulse by a number of successive time slots in said multiplexed data stream determined by the pitch interval bits of the musical interval signal at the output of said address means and by a number of octave length groups of time slots determined by the octave interval bits of the musical interval signal, and then placing said delayed pulse on a second time division multiplexed data stream, means for converting said second data stream to a serial binary word, means for demultiplexing said first data stream and actuating first keyer means to connect tone generating means to first voicing means, and means responsive to said serial binary word for activating second keyer means to connect tone generating means to second voicing means.

14. The electronic organ of claim 13 wherein:

said means for converting comprises a binary encoder synchronized with said scanning means, and a second multiplexer, said means for actuating includes a demultiplexer.

15. The electronic organ of claim 13 wherein said means responsive to said serial binary word includes:

a serial data input connected to said means for converting, said serial binary word being received at said serial data input, a plurality of latches including respective input terminals connected in parallel to said data input, said latches further including respective clocking inputs and respective output terminals, a plurality of tone sources, demultiplexer driver means connected to said latch clocking inputs for sequentially clocking said latches to transfer the data signals on their respective said input terminals to their respective said output terminals, and a tone selector connected to at least some of said output terminals and to said tone sources, said selector having an input and means for placing selected ones of said tones on its output in response to data signals on some of said latch output terminals.

16. The electronic organ of claim 15 wherein said selector comprises:

a pitch selector connected to some of said output terminals and having an output line, octave selector means connected to the remaining output terminals and to said pitch selector output line for selectively dividing the frequency present on said pitch selector output line in response to data signals on the remaining said output terminals.

17. The electronic organ demultiplexer of claim 16 wherein said tone sources together comprise the tones of a single musical octave, and said octave selector means includes a plurality of cascaded frequency dividers having respective outputs which are selectively connected to an octave selector output line in response to data signals on the remaining said output terminals.

18. The electronic organ demultiplexer of claim 17 including amplification and voicing means connected to said octave selector output line.

19. The electronic organ demultiplexer of claim 15 wherein said serial data input carries time division multiplexed serial binary words each comprising more than one bit.

20. In an electronic organ including a solo manual, an accompaniment manual, a multiplexer which scans at least one of the manuals to produce a multiplexed data stream comprising respective time slots corresponding to successive keys of the scanned manual wherein key down signals appear in time slots corresponding to notes of depressed keys of the scanned manual, a method for producing rhythmic patterns of notes comprising:

producing an encoded chord signal in response to the depression of one or more keys in the accompaniment manual corresponding to a player selected chord which comprises data corresponding to the notes of the selected chord, storing in a memory data which represents a plurality of rhythmic patterns of musical intervals, said data being in the form of multiple bit binary words for respective musical intervals wherein each said binary word comprises one group of bits corresponding to a pitch interval less than an octave in length and the remaining group of bits corresponds to an octave interval which is an integer number of octaves long, calling forth a selected one of the stored patterns one musical interval at a time, and generating a control pulse at a predetermined time in the scan of the manual, delaying the control pulse by a number of successive time slots in the multiplexed data stream controlled by the pitch interval bits of the musical interval which is called forth and by a number of octave length groups of time slots determined by the octave interval bits of the musical interval called forth, and then placing the control pulse on the data stream.

21. The method of claim 20 and calling forth from the memory successive stored musical intervals of the selected pattern at a rhythmic rate much slower than the rate at which the manual is scanned.

22. The method of claim 21 including providing rhythmic beat signals from a rhythm unit and synchronizing the calling forth of the stored musical intervals with the beat signals.

23. The method of claim 20 wherein the solo manual is the scanned manual and the control pulse is generated during the time slot in the top octave of the solo manual corresponding to the root note of the selected chord, and wherein the root note is determined by a pre-programmed memory for each of the chords which is capable of selection by the player.

24. The method of claim 20 and selectively delaying the control pulse an additional time slot for at least one of the intervals in the selected pattern when a minor or diminished chord is selected by the player.

* * * * *